US011598510B2

(12) United States Patent
Priestly

(10) Patent No.: US 11,598,510 B2
(45) Date of Patent: Mar. 7, 2023

(54) COLLAR FOR A RECESSED LIGHT FITTING

(71) Applicant: HALODAWN LTD, Hampshire (GB)

(72) Inventor: Toby Priestly, Hampshire (GB)

(73) Assignee: Halodawn Ltd, Hampshire (GB)

( * ) Notice: Subject to any disclaimer, the term of this patent is extended or adjusted under 35 U.S.C. 154(b) by 0 days.

(21) Appl. No.: 17/610,803

(22) PCT Filed: May 13, 2020

(86) PCT No.: PCT/EP2020/063301
§ 371 (c)(1),
(2) Date: Nov. 12, 2021

(87) PCT Pub. No.: WO2020/229525
PCT Pub. Date: Nov. 19, 2020

(65) Prior Publication Data

US 2022/0205617 A1 Jun. 30, 2022

(30) Foreign Application Priority Data

May 13, 2019 (GB) ..... 1906709

(51) Int. Cl.
*F21V 17/06* (2006.01)
*F21S 8/02* (2006.01)
(Continued)

(52) U.S. Cl.
CPC ..... *F21V 17/06* (2013.01); *F21S 8/02* (2013.01); *F21S 8/022* (2013.01); *F21S 8/024* (2013.01);
(Continued)

(58) Field of Classification Search
CPC ..... F21V 17/168; F21V 21/04; F21V 21/041; F21V 21/042; F21V 21/043;
(Continued)

(56) References Cited

U.S. PATENT DOCUMENTS 669,357 A * 3/1901 Stanley ..... F21V 17/00 362/434
2,236,940 A * 4/1941 Foley ..... F21V 15/02 362/378
(Continued)

FOREIGN PATENT DOCUMENTS

CN 109329235 A * 2/2019
DE 29705478 U1 7/1997
(Continued)

OTHER PUBLICATIONS

ESPACENET machine translation of DE-102014101337-A1. (Year: 2022).*
(Continued)

*Primary Examiner* — Colin J Cattanach
(74) *Attorney, Agent, or Firm* — Leydig, Voit & Mayer, Ltd.

(57) ABSTRACT

The present disclosures provides a collar for positioning at least partially around a recessed light fitting and between the recessed light fitting and a structural body. The collar comprises a plurality of collar portions each of which are configured to surround a portion of the recessed light fitting.

19 Claims, 7 Drawing Sheets

(51) Int. Cl.

| | |
|---|---|
| ***F21V 21/04*** | (2006.01) |
| ***F21V 17/10*** | (2006.01) |
| ***F21V 17/16*** | (2006.01) |

(52) U.S. Cl.

CPC ..... *F21S 8/026* (2013.01); *F21S 8/028* (2013.01); *F21V 17/102* (2013.01); *F21V 17/104* (2013.01); *F21V 17/107* (2013.01); *F21V 17/16* (2013.01); *F21V 17/164* (2013.01); *F21V 21/04* (2013.01); *F21V 21/041* (2013.01); *F21V 21/042* (2013.01); *F21V 21/043* (2013.01); *F21V 21/044* (2013.01); *F21V 21/045* (2013.01); *F21V 21/046* (2013.01); *F21V 21/047* (2013.01); *F21V 21/048* (2013.01); *F21V 21/049* (2013.01)

(58) Field of Classification Search

CPC .... F21V 21/044; F21V 21/045; F21V 21/046; F21V 21/047; F21V 21/048; F21V 21/049; F21S 8/02; F21S 8/022; F21S 8/024; F21S 8/026; F21S 8/028

See application file for complete search history.

(56) References Cited

U.S. PATENT DOCUMENTS

| | | | | |
|---|---|---|---|---|
| 3,564,235 | A * | 2/1971 | Nicokiris | F21V 5/06 362/147 |
| 2007/0290112 | A1* | 12/2007 | Orth | H04R 1/026 248/317 |
| 2018/0223553 | A1* | 8/2018 | Thompson | F21V 17/12 |
| 2018/0224095 | A1* | 8/2018 | Cohen | F21V 21/04 |
| 2020/0149721 | A1* | 5/2020 | Warner | F21V 21/04 |

FOREIGN PATENT DOCUMENTS

| | | | | |
|---|---|---|---|---|
| DE | 102014101337 | A1 * | 5/2015 | F21S 8/02 |
| DE | 102014101337 | A1 | 5/2015 | |
| EP | 2706284 | A1 * | 3/2014 | F21S 8/02 |
| EP | 2818796 | A1 * | 12/2014 | F21V 15/012 |
| GB | 2479894 | A | 11/2011 | |
| JP | H10162622 | A | 6/1998 | |
| JP | 4214689 | B2 * | 1/2009 | |
| JP | 4214689 | B2 | 1/2009 | |
| KR | 20150042130 | A * | 4/2015 | |

OTHER PUBLICATIONS

European Patent Office, Search Report in International Application No. PCT/EP2020/063301 (dated Jul. 30, 2020).

* cited by examiner

PRIOR ART

PRIOR ART

COLLAR FOR A RECESSED LIGHT FITTING

CROSS-REFERENCE TO RELATED APPLICATIONS

This application is a national phase application of International Patent Application No. PCT/EP2020/063301, filed May 13, 2020, which claims priority to United Kingdom Patent Application No. GB 1906709.9, filed May 13, 2019, both of which are incorporated by reference herein in their entireties for all purposes.

TECHNICAL FIELD

The present invention relates to a collar for positioning around a recessed light fitting, a recessed light assembly, a kit, a method of installing a collar, and the use of a plurality of collar portions.

BACKGROUND

A recessed light or downlight is a light fitting which is installed into a cavity or opening (i.e. recessed) in a structural body. The structural body is typically a ceiling, but also may be a wall, floor, column, pillar or the like. The source of light (i.e. the bulb) is typically within the cavity in the structural body and the large housing and wiring components of the light are usually hidden behind the structural body and an outer portion of the fitting at which the bulb is exposed. Any retaining mechanism for holding the recessed light fitting is typically located within the cavity of the structural body.

During insertion and removal of the recessed light fitting, the outer surface of the structural body may become damaged (typically by the retaining mechanism). This damage may be chipping or cracking of paint to the edges of the cavity and is undesirable for aesthetic reasons since it often becomes visible around the light fitting. Additionally, normal operation of the light may cause damage in this area. In particular, a hot bulb can cause damage to brittle plaster in this region.

The present invention is directed to overcoming such problems.

SUMMARY

The present invention provides a collar according to claim 1. The collar covers the area immediately surrounding the recessed light fitting and hence hides any unsightly damage caused by insertion and removal of the recessed light fitting or caused during usage of the light fitting. As the collar comprises a plurality of collar portions, it can be installed without the need to remove the recessed light fitting from its electrical connection. In particular, the collar can be installed whilst the light fitting is in the cavity by locating the portions around it. Accordingly, the present collar may be installed without the need for an electrician or specialist skills.

The present invention further provides a recessed light assembly according to claim 17.

The present invention further provides a kit according to claim 13.

The present invention further provides a method of installing a collar according to claim 15.

Each collar portion may comprise attachment means or a fastener for attaching to a further collar portion of the plurality of collar portions. This allows the attachment means to fix to one another and co-locate to ensure that they remain located around the recessed light fitting.

The attachment means may comprise a projection and a first slot for engaging the first slot and projection respectively of the further collar portion. This is a convenient method for attaching adjacent collar portions. The projection and slot ensure that the collar portions are located accurately with respect to each other and minimise any offset between the portions. This results in minimal visible breaks between the collar portions.

The attachment means of each collar portion may further comprise a second slot, and the projection is retained within the second slot. This may allow for easier manufacture of the collar portions.

The collar may consist of two collar portions. Having two collar portions enables a single person to easily install the collar without too much difficulty or movement of the recessed light fitting.

Each collar portion may be a substantially semi-circular strip. Generally recessed light fittings have a substantially circular surface passing through the structural body and hence substantially semi-circular strips match with these and can allow for a tight fit thereto.

Each collar portion may be identical. Identical collar portions reduce the associated manufacturing costs and increase the ease of replacement should a collar portion become damaged.

The plurality of collar portions may together surround the entirety of the recessed light fitting in use. Surrounding the entirety of the recessed light fitting in use allows for a consistent finish and covers the complete area which may become damaged.

Each collar portion may increase in thickness from an outer edge towards an inner edge. This increase in thickness blends the collar portion to the structural body and allows a thicker portion of the collar in the regions which contact the recessed light fitting where necessary.

An inner surface of each collar portion may comprise a compressible layer. The compressible layer allows the collar portions to sit level on the structural body, regardless of any undulations in its surface. For example, such undulations are common in a stucco/popcorn/textured ceiling.

Each collar portion may comprise an inner region of substantially constant thickness along the inner edge. The portion of substantially constant thickness can contact the recessed light fitting to ensure that it is aligned accurately to the structural body.

One or more of the collar portions may comprise one or more of: a fragrance; a pesticide; and/or a pest repellent. In addition to a pesticide, the one or more collar portions may comprise a pest attractant. A fragrance may be impregnated or otherwise provided with the collar portion to provide a desirable aroma in the area. The pesticides and/or pest repellents are for combatting flying pests in high areas in rooms. Recessed light fittings are commonly where these pests may land and potentially leave droppings (which show up as dark spots on the fitting). By having a pest repellent or pesticide in the collar portion, these can be reduced. A pest attractant can attract the pest, before it is killed by the pesticide.

The recessed light fitting may further comprise biasing means attached to the inner portion for retaining the recessed light fitting in the cavity. The biasing means help retain the recessed light fitting in the cavity and can contribute towards the damage which the present invention seeks to conceal.

The recessed light assembly may further comprise the structural body.

The recessed light fitting may be connected to a source of electricity and the plurality of collar portions are slid between the outer portion and the structural body without disconnecting the source of electricity from the recessed light fitting. This allows an easy installation of the collar portions without the need for an electrician.

BRIEF DESCRIPTION OF THE DRAWINGS

The present invention will now be described, by way of example only, with reference to the accompanying figures in which.

DETAILED DESCRIPTION

Figure 1:
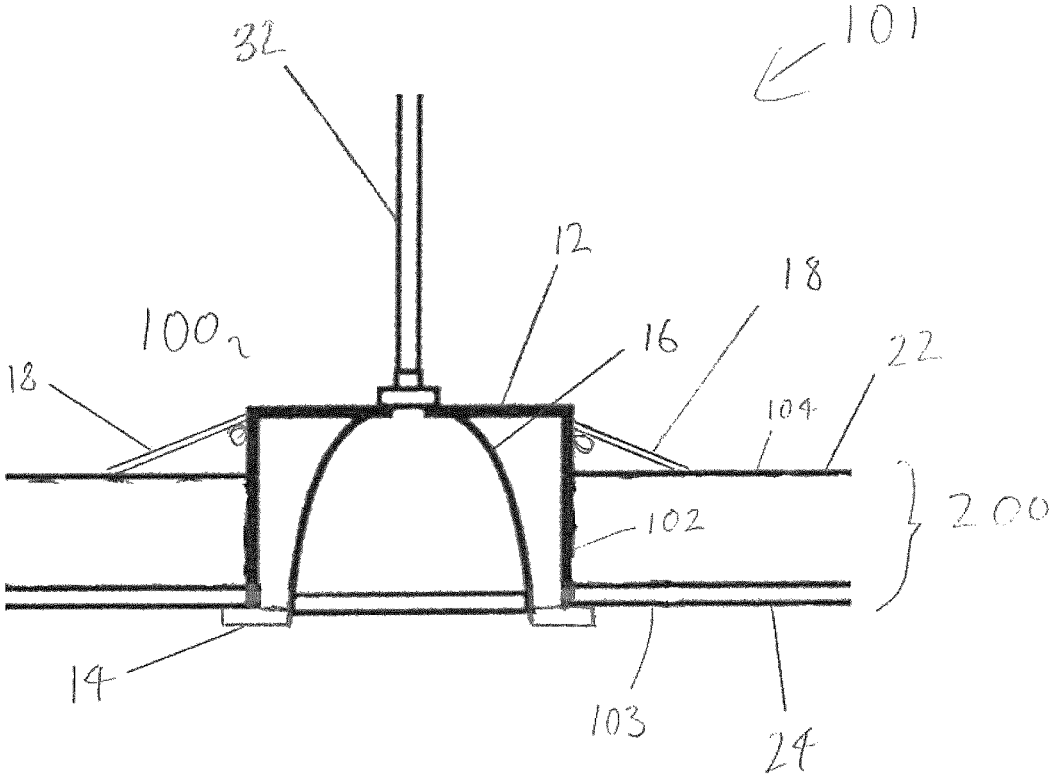
FIG. 1 is a cross-section of a prior art recessed light assembly.

A prior art recessed light assembly 101 is shown in FIG. 1. The recessed light assembly 101 comprises a recessed light fitting 100. The recessed light fitting 100 is installed within a cavity 102 in a structural body 200. The recessed light fitting 100 comprises an outer portion 14 which is in contact with an outer surface 103 of the structural body 200. The outer portion 14 is generally on the side of the recessed light fitting 100 from which light emanates into the area to be lit. The recessed light fitting 100 further comprises an inner portion 12 extending from the outer portion 14. The inner portion 12 is positioned within and passes through the cavity 102 of the structural body 200. A source of light 16 is provided within the inner portion 12. The source of light may be any suitable bulb. The recessed light fitting 100 may be retained within the cavity of the structural body 200 by biasing means 18. In particular, the biasing means 18 may be a spring clip which is biased to retain the recessed light fitting 100 within the cavity against the force of gravity as shown in FIG. 1 (for a ceiling light). A source of electrical energy 32 is connected to the recessed light fitting 100 to power the light source 16. The source of electrical energy 32 may include a wiring box attached to the recessed light fitting 100. The source of electrical energy 32 may be a mains power connection in a home.

The structural body 200 may be any structure adjacent or bounding an area to be lit. Typically, the structural body 200 is a ceiling. However, this structural body 200 may alternatively be a wall, floor, pillar, column, furniture structure or the like. The structural body 200 generally comprises an outer surface 103 which faces the area to be lit and an inner surface 104 which faces away from the area to be lit and is generally hidden in normal use. The structural body 200 may comprise a primarily structural layer 22 forming the inner surface 104 and a finish layer 24 forming the outer surface 103. The finish layer 24 may comprise a layer of plaster and/or paint. The structural layer 22 may be a layer of plasterboard.

Figure 2:
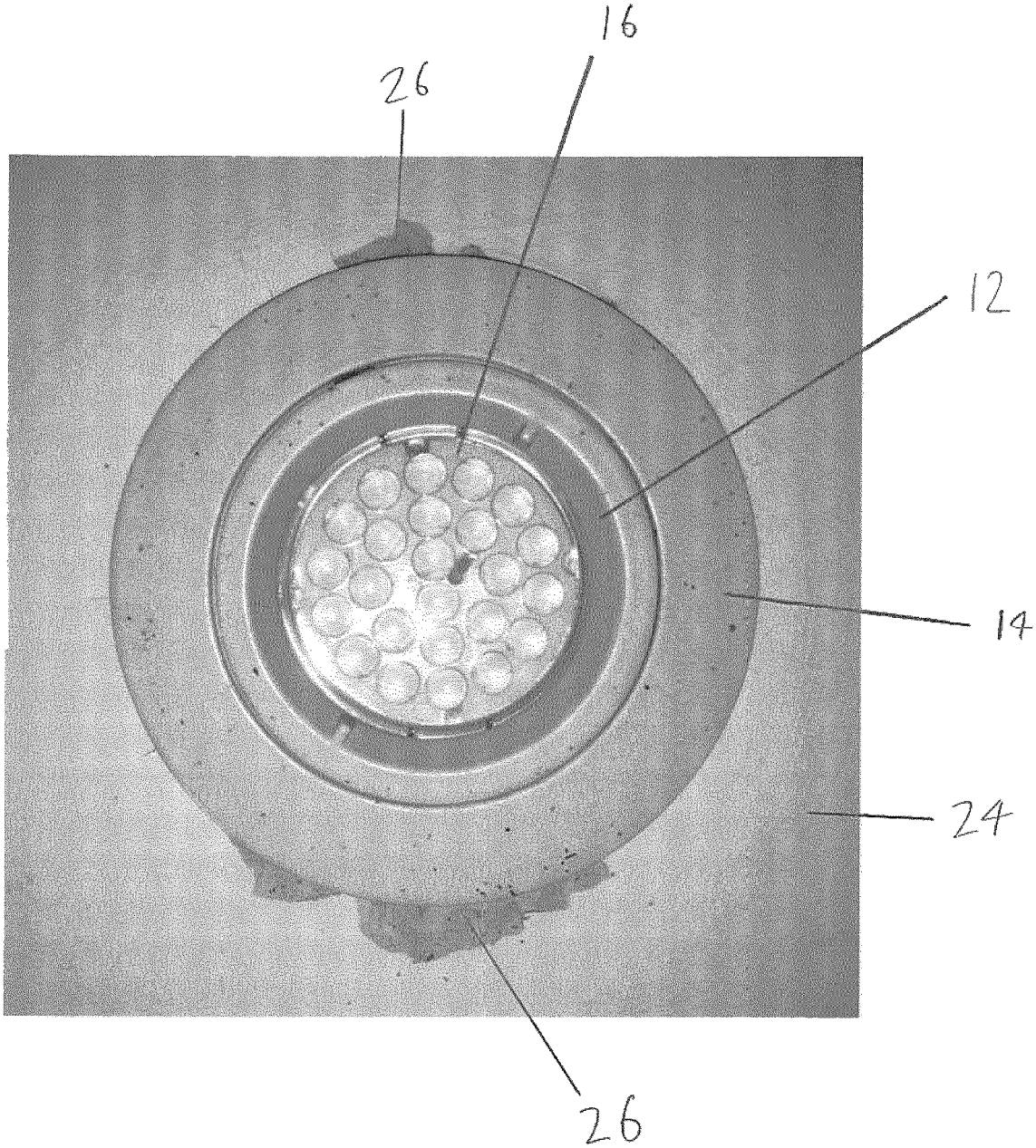
FIG. 2 is a bottom plan view of a prior art recessed light assembly.

During insertion and/or removal of the recessed light fitting 100, or normal use over time, the structural body 200 may be damaged. In particular, the finish layer 24 may crack and/or flake as shown in FIG. 2. FIG. 2 shows a prior art recessed light fitting 100 which has been removed and installed within a structural body a number of times. As can be seen, a large amount of paint flaking 26 is present which is generally unsightly.

Figure 5:
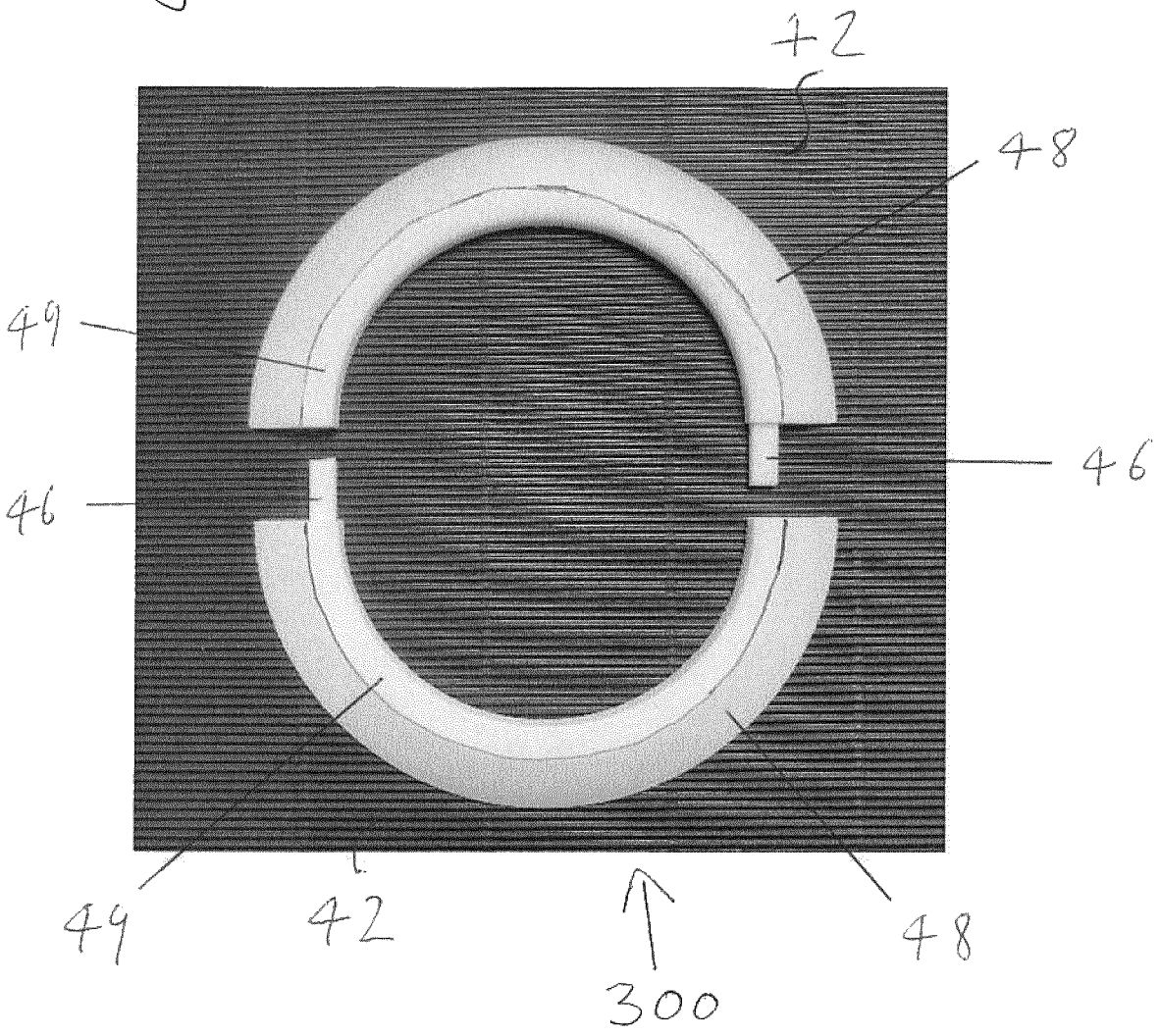
FIG. 5 is a collar according to the present invention including two of the collar portions of FIGS. 3 to 4C.

FIG. 5 shows a collar 300 comprising first and second collar portions 42 in accordance with the invention for covering the flaking 26. The first and second collar portions 42 may be substantially identical to one another as shown. The collar portions 42 may be pressed together around a recessed light fitting 100 in order to form a complete collar 300. FIGS. 3 and 4A to 4C show a first or second collar portion 42 of the collar 300 in more detail. The collar portion 42 is configured to surround at least a portion of the recessed light fitting 100.

The collar portion 42 is a substantially semi-circular strip. A first collar portion 42 may be combined with a second substantially identical collar portion 42, in order to surround the entirety of the recessed light fitting 100 in use. That is, when placed adjacent to one another the two collar portions 42 together form the collar 300 which passes around the entire perimeter of the recessed light fitting 100. The collar 300 may comprise more than two collar portions 42, for example the collar 300 may be formed of three collar portions 42. The formed collar 300 may contact a band on the inner portion 12 of the recessed light fitting 100. This band surrounds an outer perimeter or circumference of the recessed light fitting 100.

The collar portion 42 may comprise an outer surface 301 for facing outwardly from the structural body 200 and an inner surface 302 for facing inwardly to and contacting the structural body 200. The collar portion 42 may comprise an external edge 303. The internal and external edges 305, 303 may extend between the inner and outer surfaces 302, 301. The collar portion 42 may extend between two ends 306. An internal annular edge 305 of the collar portion 42 may be configured to contact the recessed light fitting 100.

The collar portion 42 may include a tapered section 48 in which the thickness of the collar portion 42 increases from the external edge 303 towards the internal edge 305. Alternatively, the collar portion 42 could be substantially flat in this section. The thickness is the dimension of the collar portion 42 extending between the inner and outer surfaces 302, 301. The collar portion 42 may further comprise a region 49 of substantially constant thickness between the tapered section 48 and the internal edge 305. This region 49 is arranged to contact the outer portion of the recessed fitting 100 in use. The region 49 of substantially constant thickness may be thinner than the tapered section 48 immediately adjacent to it.

The inner surface 302 of the collar portion 42 may comprise a compressible layer. This layer could be integral with the inner surface 302 or attached thereto. The compressible layer may be a foam or sponged layer, or any other resiliently deformable layer.

Figure 3:
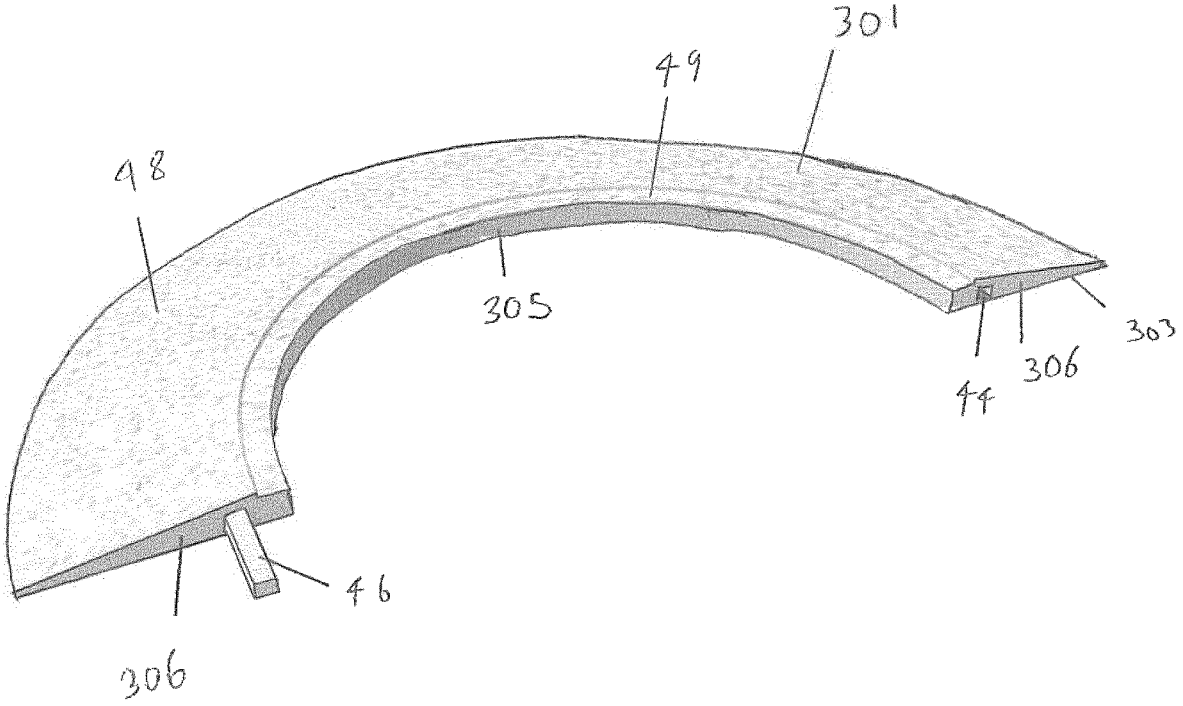
FIG. 3 is a perspective view of a collar portion of a collar according to the present invention.
Figure 4A:
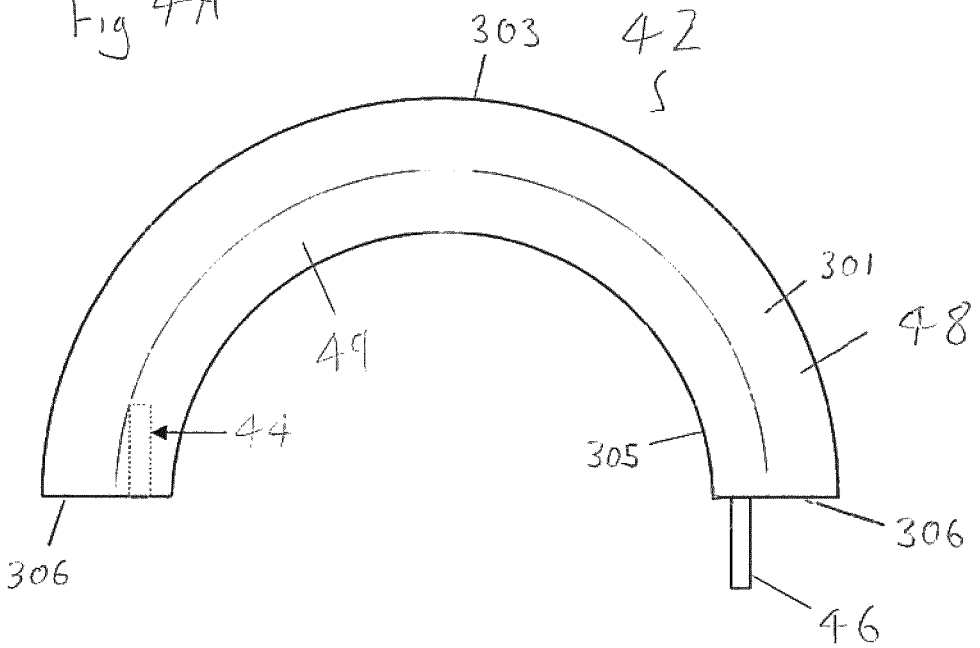
FIG. 4A is a top view of the collar portion of FIG. 3.
Figure 4B:
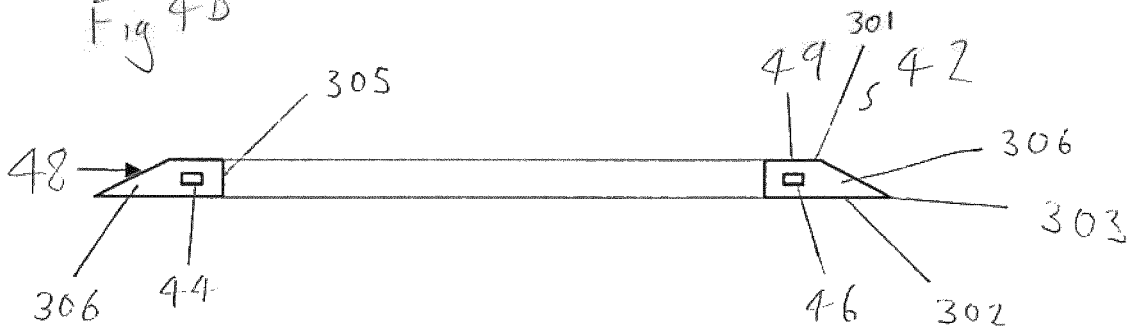
FIG. 4B is a side view of the collar portion of FIG. 3.
Figure 4C:
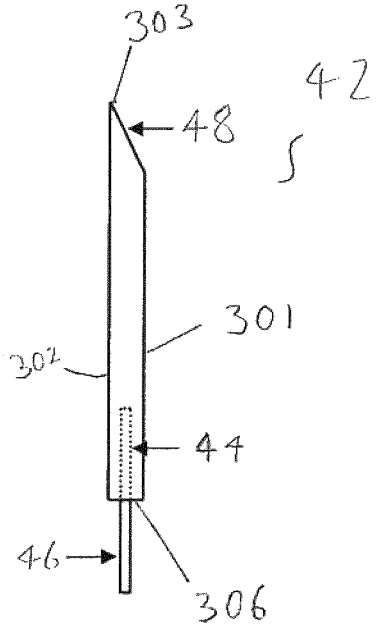
FIG. 4C is a further side view of the collar portion of FIG. 3.

The collar portion 42 may comprise attachment means or a fastener for attaching to an adjacent collar portion 42. As in the depicted embodiment, the attachment means may comprise a projection 46 and at least one slot 44 in an end 306 for engaging with the slot 44 in each end 306 and projection 46 respectively of the further collar portion 42. As shown in FIG. 3, the collar portion 42 may comprise two slots 44, one in each end 306, and the projection 46 may be provided via a moulded connection to the collar portion 42 for snap removal. The projection 46 may be snapped or broken from the remainder of a first collar portion 42 and inserted into one of the slots 44. The same is performed to a second collar portion 42, the projection 46 of which is inserted into the other slot 44 of the first collar portion 42. This allows for easier moulding of the collar portion 42. Alternatively, the projection 46 may be formed integrally with the rest of the collar portion 42 such that each collar portion 42 only comprises one slot 44.

Figure 6:
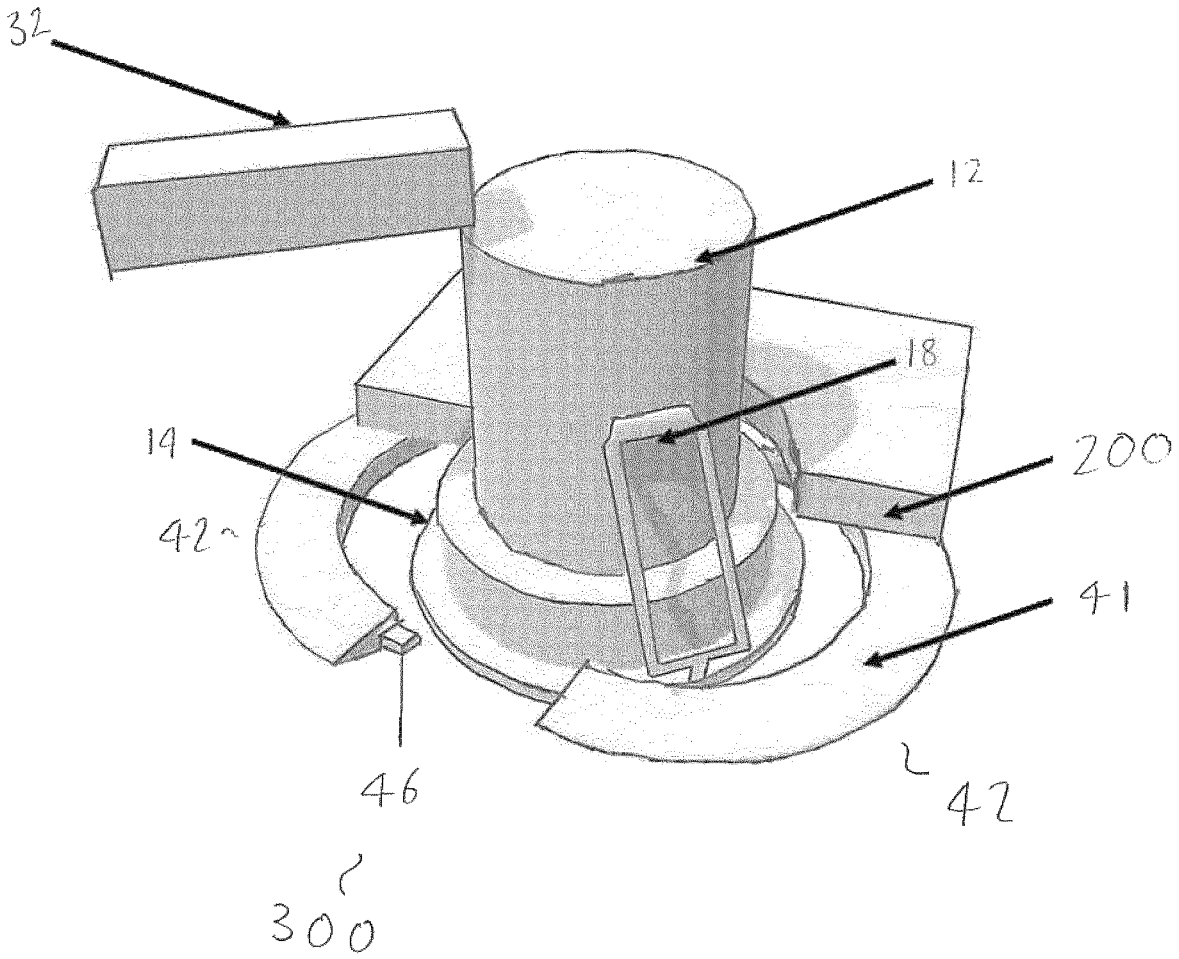
FIG. 6 is the collar of FIG. 5 and a recessed light fitting in an exploded configuration during installation.

FIG. 6 shows the installation of the collar 300 around a recessed light fitting 100. The structural body 200 is shown in FIG. 6 in partial cutaway for ease of reference. However, in practice the structural body 200 would extend across the entirety of the recessed light element 100. The recessed light element 100 includes biasing means 18 in the form of spring clips which retain the recessed light fitting 100 within the cavity 102 of the structural body 200. The collar portions 42 are slid or pushed between the outer portion 14 of the recessed light fitting 100 and the structural body 200. In order to achieve this installation, the biasing means 18 need to only be slightly displaced on the internal side to provide space for the collar 300 and hence no external damage is caused. The projection 46 of the first collar portion 42 is received within the slot 44 of the second collar portion 42 in order to form the complete collar 300 around the recessed light fitting 100. As this is achievable with the recessed light fitting 100 in situ, there is no need to disconnect the electrical connection 32 from the recessed light fitting 100 or to remove the recessed light fitting 100 from the cavity 102.

Figure 7:
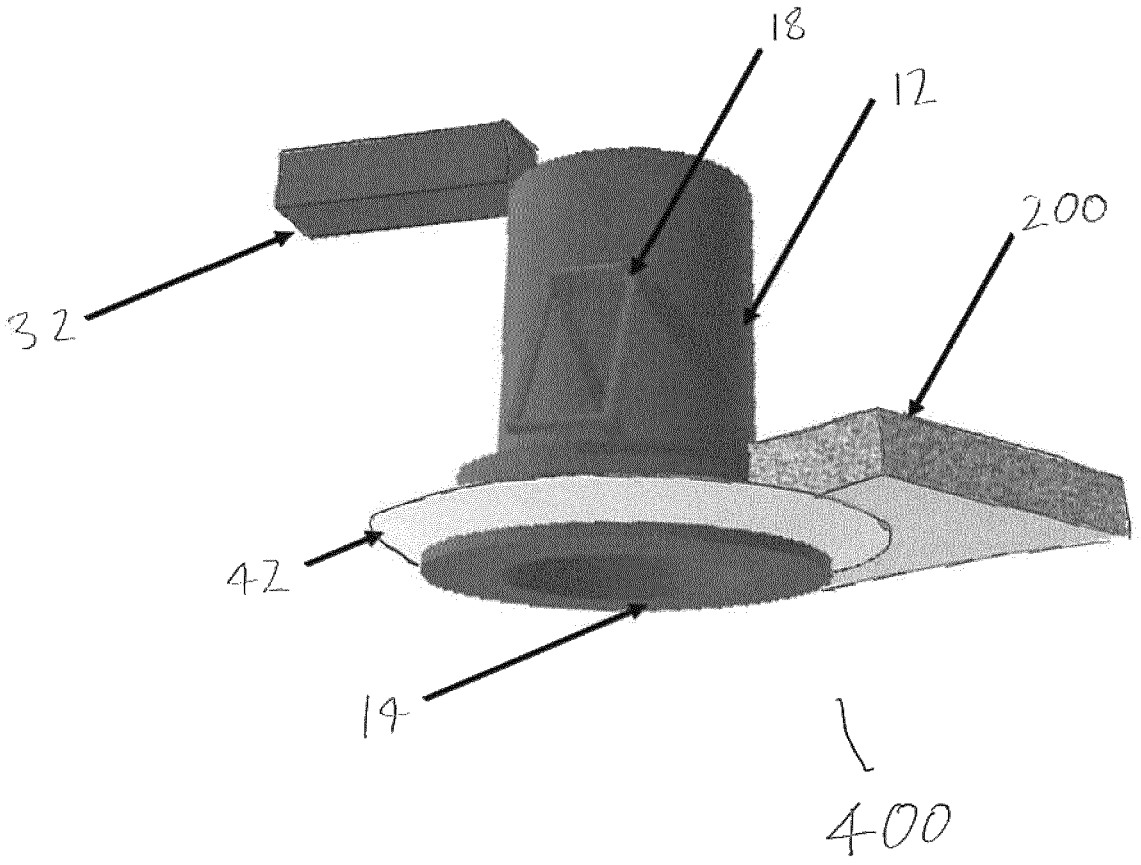
FIG. 7 is a collar according to the present invention installed with a recessed light fitting.

This results in the recessed light assembly 400 shown in FIG. 7 in which the collar portions 42 are connected to form the collar 300 around the recessed light fitting 100, which is partially located within the structural body 200. The collar portions 42 substantially surround the outer portion 14 of the recessed light assembly 100 and cover any damage caused to the structural body 200 during installation of the recessed light fitting 100.

One or more of the collar portions 42 may comprise a composition which is one or more of a fragrance, a pesticide, and/or a pest repellent. In particular, the pesticide may be an insecticide. In embodiments with a pesticide, the collar portion 42 may further comprise a pest attractant to attract the pests to the pesticide. Suitable compositions for these embodiments may include, as a non-limiting example, one or more of Azamethiphos, Salmosan, Alfacron 10, Alfacron Plus, and/or Snip Fly Bait.

The composition may be impregnated within the collar portion 42. Alternatively and/or additionally, the composition may be sprayed onto the collar portion 42 as a coating, applied to a film layer on the collar portion 42, or may be deposited via any suitably known method. Alternatively, the composition may be provided on a sticky-backed layer applied to the collar portion 42.

The invention claimed is:

1. A collar for positioning at least partially around a recessed light fitting and between the recessed light fitting and an outer surface of a structural body to cover an area of the outer surface of the structural body immediately surrounding the recessed light fitting, the outer surface facing an area to be lit by the recessed light fitting, the collar comprising a plurality of collar portions each configured to surround a portion of the recessed light fitting, wherein each collar portion is identical and for positioning between the recessed light fitting and the outer surface of the structural body.

2. The collar of claim 1, wherein each collar portion comprises attachment means for attaching to a further collar portion of the plurality of collar portions.

3. The collar of claim 2, wherein the attachment means of each collar portion comprises a projection and a first slot for engaging the first slot and projection respectively of the further collar portion.

4. The collar of claim 3, wherein the attachment means of each collar portion further comprises a second slot, and the projection is retained within the second slot.

5. The collar of claim 1, wherein the collar consists of two collar portions.

6. The collar of claim 5, wherein each collar portion is a substantially semi-circular strip.

7. The collar of claim 1, wherein, in use, the plurality of collar portions together surround the entirety of the recessed light fitting.

8. The collar of claim 1, wherein each collar portion increases in thickness from an outer edge towards an inner edge.

9. The collar of claim 8, wherein each collar portion comprises an inner region of substantially constant thickness along the inner edge.

10. The collar of claim 1, wherein an inner surface of each collar portion comprises a compressible layer.

11. The collar of claim 1, wherein one or more of the collar portions comprises one or more of: a fragrance; a pesticide; and/or a pest repellent.

12. The collar of claim 11, wherein one or more of the collar portion comprises the pesticide and further comprises an insect attractant.

13. A kit comprising:

a recessed light fitting comprising:

an outer portion; and an inner portion extending from the outer portion for positioning in a cavity of a structural body;

a collar according to claim 1.

14. The kit of claim 13, wherein the recessed light fitting further comprises biasing means attached to the inner portion for retaining the recessed light fitting in the cavity.

15. A method of installing the collar of claim 1, comprising the steps of:

providing a recessed light fitting extending through a cavity in a structural body, the recessed light fitting comprising:

an outer portion; and an inner portion extending from the outer portion into the cavity; and positioning the plurality of collar portions between the outer portion and an outer surface of the structural body to cover an area of the outer surface of the structural body immediately surrounding the recessed light fitting, the outer surface facing an area to be lit by the recessed light fitting.

16. The method of claim 15, wherein the recessed light fitting is connected to a source of electricity and the plurality of collar portions are positioned between the outer portion and the structural body without disconnecting the source of electricity from the recessed light fitting.

17. A recessed light assembly comprising:

a recessed light fitting comprising:

an outer portion; and an inner portion extending from the outer portion for positioning in a cavity of a structural body, a collar for positioning at least partially around the recessed light fitting and between the recessed light fitting and an outer surface of the structural body, the outer surface facing an area to be lit by the recessed light fitting, the collar comprising a plurality of collar portions each configured to surround a portion of the recessed light fitting, wherein each collar portion is identical and is for positioning between the recessed light fitting and the outer surface of the structural body to cover an area of the outer surface of the structural body immediately surrounding the recessed light fitting.

18. The recessed light assembly of claim 17, wherein the recessed light fitting further comprises biasing means attached to the inner portion for retaining the recessed light fitting in the cavity.

19. The recessed light assembly of claim 17, further comprising the structural body having the cavity, wherein the inner portion is positioned in the cavity and the collar is positioned between the recessed light fitting and the structural body.

* * * * *